8-107 SR
FIP8309 XR 4,094,806

United States Patent [19]
Wiers
[11] 4,094,806
[45] June 13, 1978

[54] PHOTOACTIVATED BLEACH-COMPOSITIONS

[75] Inventor: Brandon Helmholz Wiers, Forest Park, Ohio

[73] Assignee: The Procter & Gamble Company, Cincinnati, Ohio

[21] Appl. No.: 734,891

[22] Filed: Oct. 22, 1976

Related U.S. Application Data

[63] Continuation-in-part of Ser. No. 564,587, Apr. 3, 1975, abandoned.

[51] Int. Cl.[2] ..... C11D 7/54; C11D 7/50
[52] U.S. Cl. ..... 252/102; 8/103; 8/107; 8/111; 252/95; 252/99; 252/103
[58] Field of Search ..... 252/95, 94, 102, 103, 252/524; 260/314.5; 8/103, 107, 108, 110, 111

[56] References Cited

U.S. PATENT DOCUMENTS

| | | | |
|---|---|---|---|
| 3,927,967 | 12/1975 | Spearman | 252/95 X |
| 4,033,718 | 7/1977 | Holcombe et al. | 252/99 X |

FOREIGN PATENT DOCUMENTS

| | | |
|---|---|---|
| 72-3212 | 2/1973 | South Africa. |

*Primary Examiner*—Mayer Weinblatt
*Attorney, Agent, or Firm*—Richard C. Witte; Thomas H. O'Flaherty; David F. Chalmers

[57] ABSTRACT

An unbuilt liquid detergent composition containing sulfonated zinc phthalocyanine as a bleach photoactivator is provided for removing stains from textiles. A process for removing stains from textiles by treating the textiles with an aqueous solution of the unbuilt detergent compositions of this invention in the presence of visible light and oxygen is provided. Preferred compositions contain a high proportion of zinc phthalocyanine tri and tetra sulfonates in the bleach photoactivator component.

14 Claims, No Drawings

PHOTOACTIVATED BLEACH-COMPOSITIONS

CROSS REFERENCE TO RELATED APPLICATION

This application is a continuation-in-part of copending application Ser. No. 564,587 filed Apr. 3, 1975, now abandoned.

BACKGROUND OF THE INVENTION

1. Field of the Invention

In conventional household laundry processes for white goods such as bed linen, table linen, and white cotton goods, the articles are subjected to a combined washing and bleaching process in which the articles are treated in an aqueous bath containing an organic detergent and a bleaching (i.e., stain removing) agent. Other conventional detergent aids such as alkaline builders, for example sodium tripolyphosphate; soil suspending agents, for example sodium carboxymethyl cellulose; and optical brightening agents may also be present. The stain-removal agent is usually a "per" compound which liberates oxygen at the washing temperature. Sodium perborate is the most commonly used material for this purpose. In some instances, the stain removal may be carried out as a separate step using a compound which liberates available chlorine, such as sodium hypochlorite or N-chloro organic compounds such as dichlorocyanuric acid or its salts or trichlorocyanuric acid.

These conventional chemical processes for stain removal result in varying amounts of degradation of the textile fibers.

Dye-photoactivated oxidation reactions are known in organic chemistry, and this type of oxidation has been applied in textile bleaching processes. Very effective stain removal from textiles can be obtained by subjecting the textiles to treatment in an aqueous bath in the presence of atmospheric oxygen and certain photoactivating compounds, while at the same time irradiating the textiles with visible light, and this stain removal process can be conveniently combined with a conventional washing process.

2. Prior Art

South African No. 72-3212, an application for letters patent filed May 10, 1972, by The Procter & Gamble Company, which was laid open for public inspection on Feb. 23, 1973, and sealed on June 4, 1973, which is herein incorporated by reference, discloses a photoactivated bleaching process whereby stains are removed from textiles through the use of built detergent solutions containing sulfonated zinc phthalocyanine. These solutions are irradiated with visible light and exposed to oxygen during the washing and bleaching process. A preferred photoactivator was said to be sulfonated zinc phthalocyanine which was free from unsulfonated zinc phthalocyanine. Variation in the degree of sulfonation of zinc phthalocyanine was not found to affect the efficacy of the material as a photoactivator. It was shown to be essential that the bleach liquor contain a water-soluble alkaline detergency builder salt.

Subsequent to the South African patent application referred to above, it was demonstrated in the United States application of Thomas C. Holcombe and Robert H. Schultz, Ser. No. 419,320, filed Nov. 27, 1973, and entitled "Photoactivated Bleach—Compositions and Process", now abandoned, and the copending Divisional Application thereof, Ser. No. 611,588, filed Sept. 8, 1975 now U.S. Pat. No. 4,033,718, that the degree of sulfonation of zinc phthalocyanine does effect the efficacy of the material as a bleach photoactivator. The tri and tetra sulfonates were found to be unexpectedly effective bleach photoactivators for removing stains from textiles.

A process of bleaching textiles, especially in relation with a washing and bleaching process for household laundry, is provided by the use of photoactivated bleaches such as sulfonated zinc phthalocyanine and an alkaline builder in the presence of visible light and atmospheric oxygen. U.S. Pat. No. 3,927,967 to P. R. H. Speakman, issued Dec. 23, 1975, an entitled "Photoactivated Bleaching Process and Composition", and which is incorporated herein by reference, is directed to this process and certain compositions containing the photoactivated bleaches. This patent teaches that a builder salt is necessary, and that mere alkalinity is not effective for noticeable stain reduction on textiles. In this reference and in the two references above, the emphasis is on granular detergent compositions.

Zinc phthalocyanine was first prepared by Sir Reginald Linstead and co-workers at the Imperial College of Science and Technology of London in the 1930's, as reported in Barrett, Dent, and Linstead, "Journal of the Chemical Society", (1936) at page 1719. Then, as now, the zinc compound has tended to live in the shadow of its copper analog which is now produced in quantities of millions of pounds per year for use as pigments and dyes. The chemistry of the zinc compound is similar to that of the copper compound, in that each can be made by similar processes; each occurs in three crystalline phase structures; and each undergoes similar chemical reactions such as chlorination and sulfonation. However, the properties of the analogs are sufficiently distinct that it is mainly the copper compounds that have found commercial utilization.

Unsubstituted metal phthalocyanines are soluble in water to an unusually low degree and are used as pigments. Water solubility can be achieved to a progressively greater degree by introduction of hydrophilic groups such as sulfo, carboxy, or chloromethyl groups into the phthalocyanine molecule. This is most conveniently done by sulfonation, and up to four sulfo groups can be introduced by the use of hot oleum. Sulfonated phthalocyanines are useful as direct dyes, because they have an affinity for cellulose in the form of either cotton or paper pulp. Copper is the only metal used commercially in this way, and produces dyes that are blue to yellow-green in color, depending on the other substitutents in the molecule. A good reference work on phthalocyanine pigments and dyes is "The Chemistry of Synthetic Dyes and Pigments", edited by H. A. Lubs, Reinhold, N.Y. (1955).

The process of bleaching polymaleate polymers by irradiating them with UV light in the presence of hydrogen peroxide is known. This process is described in U.S. Pat. No. 3,496,150. Percentages and ratios given throughout the application are by weight unless otherwise indicated.

SUMMARY OF THE INVENTION

According to this invention, there is provided an unbuilt liquid detergent composition comprising a water-soluble organic surfactant and a photoactivator wherein the photoactivator consists of from 0.025 to 1.25% sulfonated zinc phthalocyanine by weight of the composition, preferably 0.04 to 0.80% by weight of the composition. In a preferred composition the sulfonated zinc phthalocyanine contains a high proportion of tri and tetra sulfonated zinc phthalocyanines.

The compositions of the invention also contain from 0 to about 5% of an electrolyte which is not an alkaline detergency builder and from about 1 to about 90% of a solvent which is chosen from the group consisting of water and water-alcohol mixtures. Various components may be optionally added to the compositions of the invention as hereinafter detailed.

In another aspect of the invention, a process for removing stains from textiles comprises treating the textiles with the unbuilt liquid detergent composition of this invention in the presence of atmospheric oxygen while irradiating the textiles with visible light.

DETAILED DESCRIPTION OF THE INVENTION

This invention is directed to liquid detergent compositions comprising a water-soluble organic surfactant and as a bleach photoactivator an amount of sulfonated zinc phthalocyanine. The liquid detergent compositions of this invention do not contain any alkaline detergency builder salts. The preferred bleach photoactivators for use in the compositions of the invention are those in which the Relative Densitometer Values (RDV) as hereinafter defined for the several species: unsulfonated ZP, monosulfonated ZP, disulfonated ZP, trisulfonated ZP, tetrasulfonated ZP, are as follows:

| Specie | RDV |
|---|---|
| Unsulfonated | 0 |
| Monosulfonated | 0 |
| Disulfonated | 0–15 |
| Tri + tetrasulfonated | 100—RDV for disulfonated |

Even more preferred bleach photoactivator species are those in which the RDVs for tri and tetra sulfonated species are even higher than those just specified, as will be hereinafter indicated.

The compositions of the invention contain from about 10 to about 80% by weight of the composition of a water-soluble organic surfactant which is selected from the group consisting of the water-soluble anionic and nonionic organic surfactants and mixtures thereof. Preferably from about 20 to about 50% by weight of the composition of such surfactants are used.

Sulfonated zinc phthalocyanine bleach photoactivator is used in the composition of the invention in an amount of from about 0.025 to about 1.25% by weight of the composition, preferably from about 0.04 to about 0.80% by weight of the composition.

Other components are used in the composition of the invention as will be described in detail hereinafter.

In the process for removing stains from textiles which is provided by the invention, stained textiles are treated in an aqueous solution of the detergent compositions of the invention in the presence of visible light and oxygen. Preferably, the treatment bath contains from 1 to 50 milligrams of sulfonated ZP per liter of treatment and from 0.2 to 2.0 grams/liter of treatment bath of water-soluble organic surfactant. The temperature of the treatment bath is from 50° to 180° F and the time of treatment may range from 15 minutes to 5 hours depending on the nature of the visible light used to irradiate the treatment bath.

The several components of the compositions of the invention and the process of the invention will now be described in turn.

Water-Soluble Organic Surfactant

Surfactants suitable for use in the liquid detergent compositions of this invention include water-soluble organic, nonionic, anionic, zwitterionic, and ampholytic detergent compounds. Generally water-soluble organic anionic or nonionic surfactants or mixtures thereof are used.

Examples of water-soluble organic nonionic surfactants for use in the preparation of a liquid detergent composition are:

(1) The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substitutent in such compounds may be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-630 marketed by the GAF Corporation; and Trition X-45, X-114, X-100 and X-102, all marketed by the Rohm and Haas Company.

(2) The water-soluble condensation products of aliphatic alcohols with ethylene oxide. The alkyl chain of the aliphatic alcohol may either be straight or branched and generally contains from about 8 to about 22 carbon atoms. The polyalkylene alkanol condensate contains 2 to 15 moles of alkyleneoxy groups. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms in length and wherein the condensate contains about 6 moles of ethylene oxide per mole of alcohol, and the condensation product of about 9 moles of ethylene oxide with the above-described coconut alcohol. An example of a commercially available nonionic surfactant of this type is Neodol 23-6.5 marketed by the Shell Chemical Company.

(3) The water-soluble condensation products of ethylene oxide with a hydrophobic base formed by the condensation of propylene oxide with propylene glycol. The hydrophobic portion of these compounds has a molecular weight of from about 1500 to 1800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

(4) The water-soluble condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40 to about 80% by weight of polyoxyethylene and has a molecular weight of from about 5,000 to about 11,000. Examples of this type of nonionic surfactant include certain of the commercially available Tetronic compounds marketed by the Wyandotte Chemicals Corporation.

(5) A water-soluble trialkyl amine oxide having a straight chain alkyl group of 10 to 14 carbon atoms and two short chain alkyl groups with 1 to 2 carbon atoms.

Numerous water-soluble anionic surfactants are suitable for use in the preparation of liquid detergent compositions. These include the alkali metal, ammonium, amine and alkanolamine salts of $C_{10}$–$C_{14}$ linear alkyl aryl sulphonic acids, $C_{10}$–$C_{16}$ $\alpha$-olefin sulphonic acids, $C_{10}$–$C_{18}$ alkylsulfuric acids, $C_{10}$–$C_{18}$ polyglycol ether sulfuric acids and $\alpha$-sulphonated $C_{12}$–$C_{18}$ fatty acids.

The anionic component of liquid detergent compositions is preferably a high sudsing alkanolamine salt of a water-soluble organic anionic acid surfactant. Suitable examples include alkylbenzene sulfonic acids, alkyl sulfuric acid, esters of fatty acids sulfonated in the alpha position, alpha olefin sulfonic acids, and mixtures thereof. The alkanolamine anionic salts are prepared by neutralizing the anionic sulfuric or sulfonic organic acid with an alkanolamine selected from the group consisting of monoethanolamine, diethanolamine, triethanolamine and mixtures thereof. The triethanolamine salts are preferred herein. For example, the alkanolamine alkylbenzene sulfonate herein preferably consists of mono-, di- or tri-ethanolamine salt of a straight or branched chain alkylbenzene sulfonic acid in which the alkyl group contains from about 9 to about 15 carbon atoms. Especially preferred surfactants of this type are those in which the alkyl chain is linear and averages about 11 to 12 carbon atoms in length. Examples of alkanolamine alkylbenzene sulfonates useful in liquid detergents include monoethanolamine decylbenzene sulfonate, diethanolamine undecylbenzene sulfonate, triethanolamine dodecylbenzene sulfonate, monethanolamine tridecylbenzene sulfonate, triethanolamine tetradecylbenzene sulfonate, and diethanolamine tetrapropylenebenzene sulfonate, and mixtures thereof. Examples of commerically available alkylbenzene sulfonic acids useful in preparing the alkanolamine sulfonates of the instant invention include Conoco SA 515, SA 597, and SA 697, all marketed by the Continental Oil Company, and Calsoft LAS 99, marketed by the Pilot Chemical Company.

The alkanolamine alkyl sulfate herein consists of a mono-, di- or tri-ethanolamine salt of an alkyl sulfuric acid reaction product having the formula $ROSO_3H$ wherein R is an alkyl, straight chain or branched chain, of about 8 to 18 carbon atoms. The alkyl sulfuric acid reaction product is made by reacting sulfuric acid with a monohydric alcohol having about 8 to 18 carbon atoms. Preferably R has 12 to 16 carbon atoms.

Another anionic detergent useful herein is the water-soluble ethanolamine salt of an alpha sulfonated fatty acid. These materials have the formula

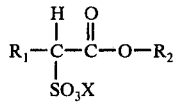

wherein X is selected from the group consisting of monoethanolamine, diethanolamine, triethanolamine and mixtures thereof; $R_1$ is an alkyl chain of from about 6 to about 20 carbon atoms (forming with the two carbon atoms a fatty acid group); and $R_2$ is an alkyl chain, the sum of the carbon atoms in $R_1$ and $R_2$ being from about 13 to about 23 carbon atoms. Specific examples of this class of compounds include esters wherein $R_2$ is methyl, ethyl, propyl, butyl, hexyl and octyl groups and the fatty acid group ($R_1$ plus the two carbon atoms in the structure above) is lauric, myristic, palmitic, stearic acids and mixtures thereof.

Yet another anionic surfactant useful herein consists of a mono-, di- or tri-ethanolamine salt of alpha olefin sulfonic acids and mixtures thereof. The sulfonation of alpha olefins and the compositions resulting therefrom are described more fully in U.S. Pat. No. 3,332,880 of Phillip F. Pflaumer and Adriaan Kessler, issued July 25, 1967, titled DETERGENT COMPOSITION which is incorporated herein by reference.

In the liquid detergent composition of this invention the water-soluble organic surfactant may be used in an amount of from 10 to 80%, preferably 20 to 50% by weight of the composition. When a mixture of nonionic and anionic water-soluble organic surfactants is used in the compositions of the invention the ratio of the amount of nonionic surfactant to the amount of anionic surfactant in its preacid form used in the composition in from about 1:8 to 8:1, preferably from 1.4:1 to 8:1, most preferably from 2.5:1 to 5.0:1.

Sulfonated Zinc Phthalocyanine

The bleach photoactivator of this invention is sulfonated zinc phthalocyanine. The term sulfonated zinc phthalocyanine is used in this application to denote the reaction product of oleum and zinc phthalocyanine. It is known that such reaction product comprises varying proportions of the mono-, di-, tri- and tetra sulfonated zinc phthalocyanine species depending on the conditions under which the oleum and zinc phthalocyanine are reacted and on the separation procedures, which are applied to the crude reaction mixture. Preparation and characterization of sulfonated zinc phthalocyanine for use in this invention will be described hereinafter.

A very effective photoactivator for use in the process of this invention is sulfonated zinc phthalocyanine which is free from unsulfonated zinc phthalocyanine. A typical preparation is as follows: 10 grams of zinc phthalocyanine and 30 ml. of oleum (30% free $SO_3$) were stirred briskly together at 110°–120° C. for 3 hours. (Efficient stirring is essential to insure that the finished product contains no unsulfonated material.) The mixture was cooled at 0° C. and neutralized to pH 7–8 by adding 40% caustic soda solution. The resulting paste was filtered by suction, and the solid was washed with 120 ml. of cold water. The solid (19 g.) was a mixture of the sodium salt of sulfonated zinc phthalocyanine and sodium sulfate. It is a very effective photoactivator for the bleaching process.

The filtrate from the preparation was evaporated to dryness yielded a solid residue (32 g.) which is also a mixture of the sodium salt of zinc phthalocyanine and sodium sulfate but containing higher proportion of sodium sulfate. This is an effective photoactivator for the bleaching process.

Thin layer chromatography on silica gel using the lower phase of a mixture of two parts by volume of pyridine, one part by volume of chloroform and one part by volume of water as the eluant, and running unsulfonated zinc phthalocyanine on the same chromatogram, as standard, show that both samples of the sulfonated material are free from unsulfonated zinc phthalocyanine. The absence of unsulfonated zinc phthalocyanine can also be demonstrated by electrophoresis on a polyacrylamide gel using a solution buffered at pH 8.

It has been found that if the photoactivator is contaminated with unsulfonated phthalocyanine, cloth which is contacted with such material in the absence of the light may be stained with greenish spots. Sulfonated zinc phthalocyanine which is contaminated with unsulfonated material can be purified by washing the material, on a sintered glass filter with copious amounts of water until no more will dissolve. The unsulfonated material is left undissolved on the filter, and the filtrate is evaporated to dryness to produce a photoactivator which is free from unsulfonated material.

Zinc phthalocyanine was sulfonated by heating with oleum as follows:

Three hundred ml. (586 grams) of 30% oleum were placed in a 1000 ml. round-bottom vessel having a diameter of approximately 4 inches. Agitation was provided by a flat-bladed impeller conforming in profile to the rounded shape of the vessel bottom and having a maximum diameter of approximately 3½ inches. Mild agitation was provided by rotating the agitator at 100–150 r.p.m.

One hundred and twenty grams of zinc phthalocyanine were slowly added to the vessel during agitation, and the vessel thereafter maintained in an oil bath, with continued agitation, at a temperature of 110° C. for 3½ hours. The reaction mixture was quenched by pouring into 1500 ml. of ice water. After neutralizing to pH 7 with NaOH, the solution was dried and ground, yielding about 900 grams of a mixture containing 77.7% sodium sulfate, and 22.3% organic material which was chiefly the tri- and tetrasulfonated species of zinc phthalocyanine.

Other samples of sulfonated zinc phthalocyanine were prepared similarly, with modifications of the process conditions as shown in TABLE I and with batch sizes ranging from 60 to 120 grams of zinc phthalocyanine. The characterization of the various samples by the relative densitometer values is described hereinafter.

TABLE I

| Preparation of Sulfonated Zinc Phthalocyanine | | | | | Species of Sulfonated Zinc Phthalocyanine Relative Densitometer Values (RDV) | | | |
|---|---|---|---|---|---|---|---|---|
| Sample/ Example (No.) | Wt. Ratio* of Reactants | Temp. (° C.) | Agitation | Time (Hours) | Mono | Di | Tri | Tetra |
| 1 | 5.0 | 110 | Yes | 0.5 | 0 | 32 | 46 | 22 |
| | | | | 1.0 | 0 | 17 | 50 | 33 |
| | | | | 1.5 | 0 | 7.0 | 51 | 42 |
| | | | | 2.0 | 0 | 3.7 | 49 | 47 |
| | | | | 2.5 | 0 | 2.2 | 46 | 52 |
| | | | | 3.0 | 0 | 1.0 | 38 | 61 |
| | | | | 3.5 | 0 | 0.3 | 33 | 67 |
| | | | | 4.0 | 0 | 0.1 | 27 | 73 |
| | | | | 4.5 | 0 | 0 | 26 | 74 |
| | | | | 5.0 | 0 | 0 | 25 | 75 |
| 2 | 5.0 | 110 | Yes | 3.5 | 0 | 1.1 | 25 | 74 |
| 3 | 4.0 | 110 | Yes | 3.5 | 0 | 13 | 56 | 31 |
| 4 | 3.0 | 110 | Yes | 1.0 | 12 | 44 | 33 | 11 |
| | | | | 2.0 | 6.7 | 32 | 38 | 13 |
| | | | | 3.0 | 4.7 | 44 | 38 | 13 |
| | | | | 3.5 | 2.6 | 36 | 45 | 16 |
| 6 | 4.9 | 113 | No | 3.0 | 5 | 16 | 36 | 43 |
| 7 | 4.9 | 100 | Yes | 2.5 | 0 | 21 | 51 | 28 |
| 9 | 4.9 | 110 | Yes | 2.0 | 0 | 2 | 44 | 54 |
| 11 | 4.9 | 110 | Yes | 3.5 | 0 | 0 | 31 | 69 |
| 15 | 7.3 | 113 | Yes | 5.0 | 0 | 0 | 4 | 96 |

*30% oleum/zinc phthalocyanine

The organic portion of crude sulfonated zince phthalocyanine was analytically determined by a "methanol soluble" method. A 1.0 gram sample was heated to boiling on a steam plate with 200 ml. of anhydrous methanol; cooled; and filtered through a crucible. This procedure was repeated until the blue-green material was visibly removed. The methanol filtrate was evaporated and the percent soluble determined gravimetrically. A gravimetric sodium sulfate determination was occasionally made to confirm the accuracy of the methanol soluble method.

Analyses for the several species of sulfonated zinc phthalocyanine, representing different degrees of sulfonation, have been carried out principally by quantitative thin layer chromatography (TLC):

A TLC chamber was equilibrated with a mixed solvent system containing 25 ml. chloroform, 47 ml. pyridine, and 8 ml. water. The TLC plate used was glass, 20 cm. × 30 cm. in size, coated with a silica gel-kieselguhr mixture. A series of 5 micro-liter spots, each containing about 40 micrograms of sulfonated zinc phthalocyanine in aqueous solution, was placed 25 mm. from the bottom of the plate at intervals of 200 mm. The plate was dried, placed in the TLC chamber while the solvent migrated to within about 25 mm. of the top of the plate, and dried again.

Applying this method to unsulfonated zinc phthalocyanine, a single spot was obtained that migrated to the top of the TLC plate nearly as rapidly as the solvent front. Applying the method to a sample of zinc phthalocyanine sulfonate that had been sulfonated under extreme conditions, such as sample no. 15, the predominant spot migrated hardly at all. This was characterized as tetrasulfonated zinc phthalocyanine. Applying the method to samples of zinc phthalocyanine sulfonate that had been sulfonated under mild conditions led to a series of 5 spots, one of which behaved like the unsulfonated zinc phthalocyanine; one of which behaved like the material characterized above as tetrasulfonated zinc phthalocyanine; and three intermediate spots which were characterized respectively as mono-, di-, and trisulfonated phthalocyanine.

Commercial samples of sulfonated copper phthalocyanine were also examined by this method, and found to behave similarly, thus strengthening belief in the characterizations described above.

The TLC plates were photographed under ultraviolet illumination for qualitative reference purposes. They were also analyzed quantitatively by visible densitometry, using a Nester/Faust Uniscan 900. As this instrument scanned across the spots of the TLC plate, an integrating circuit printed out the areas under the reflectance curve seen by the visible light transducer. These integrated values were converted to a standardized basis of 100 units of total measured density, thereby eliminating the effects of sample concentration and the existence of by-products, if any, and putting all samples on the basis of active zinc phthalocyanine sulfonate species only. These integrated values are referred to as "relative densitometer values", or RDV's, in TABLE I and throughout this specification.

The several species of sulfonated zinc phthalocyanine can be characterized in terms of their relative densitometer values.

Using this method of characterizing the several zinc phthalocyanine sulfonate species in a sample of sulfonated zinc phthalocyanine which method is as described in the above-mentioned copending application by Holcombe and Schultz, Ser. No. 611,588, sulfonated zinc phthalocyanine compositions which are preferred for use in this invention can be identified as shown below.

A preferred bleach photoactivator composition is:

| Sulfonated Zinc Phthalocyanine Specie | Relative Densitometer Value |
|---|---|
| Unsulfonated | 0 |
| Monosulfonated | 0 |
| Disulfonated | 0 to 15 |
| Tri- plus tetra- | (100)-(RDV for disulfonated) |

A more preferred bleach photoactivator composition is:

| Sulfonated Zinc Phthalocyanine Specie | Relative Densitometer Value |
|---|---|
| Unsulfonated | 0 |
| Monosulfonated | 0 |
| Disulfonated | 0 to 4 |
| Tetrasulfonated | 64 to 94 |
| Trisulfonated | (100)-(RDV for disulfonated)-(RDV for tetrasulfonated) |

A highly preferred bleach photoactivator composition is:

| Sulfonated Zinc Phthalocyanine Specie | Relative Densitometer Value |
|---|---|
| Unsulfonated | 0 |
| Monosulfonated | 0 |
| Disulfonated | 0 |
| Tetrasulfonated | 84 to 94 |
| Trisulfonated | (100)-(RDV for tetrasulfonated) |

All of the above mixtures of species are economically attractive because they can be made, without purification, by direct sulfonation with 15 to 65% oleum.

Solvent

The unbuilt liquid detergent compositions of this invention also contain a solvent selected from the group consisting of water and water-alcohol mixtures. Such solvents can be employed to the extent of from about 1 to 90% by weight, preferably 20 to 80% of the total detergent composition. Use of such solvents in liquid detergent compositions has several advantages. First, the physical stability of the detergent compositions can be improved by dilution with such solvents in that clear points can thereby be lowered. The diluted compositions do not cloud at the low temperatures which are commonly encountered during shipping or storing of commercially marketed detergent compositions.

Secondly, addition of solvents, especially water-alcohol mixtures, serves to regulate the gelling tendency which liquid detergent compositions often exhibit upon dilution with water.

When an alcohol-water mixture is employed as a solvent, the weight ratio of water to alcohol preferably is maintained above about 3:1, more preferably from about 4:1 to about 7:1. High alcohol (particularly ethanol) concentrations in the water-alcohol mixtures used in the instant invention are preferably avoided because of flammability problems which may arise at such higher alcohol levels.

Any alcohol containing from 1 to about 5 carbon atoms can be employed in the water-alcohol diluent used to prepare the instant detergent compositions. Examples of operable alcohols include methanol, ethanol, propanol, isopropanol, butanol, isobutanol, and pentanol; ethanol is highly preferred for general use.

Electrolyte

Another optional component which can be added to the detergent compositions of the instant invention is an electrolyte salt. Such salts may be used in an amount of from 0 to about 5% by weight of the composition. As pointed out in U.S. Pat. Nos. 2,580,173 and 3,440,171, electrolyte salts lessen the gel formation which tends to occur with alkanolamine-neutralized surfactants. Such electrolytes, when used herein in combination with a water-alcohol solvent at a weight percent of the total composition of from about 0.2 to 5% of said electrolyte salt, substantially eliminate gelation of the anionic surfactant without the need for excessively high alcohol levels.

For the unbuilt liquid detergent compositions of this invention, any electrolyte salt used should be an electrolyte salt which is not an alkaline detergency builder salt. Operable electrolyte salts include the alkali metal chlorides and sulfates and the salts formed from the reaction of alkanolamines with inorganic acids, e.g. HCl, $H_2SO_4$, and organic acids such as formic, acetic, propionic and butyric. Specific examples of such salts include sodium chloride, potassium chloride, potassium sulfate, sodium sulfate, triethanolamine sulfate, triethanolamine acetate, triethanolamine formate, monoethanolamine proprionate and diethanolamine butyrate. Of all the possible electrolyte salts useful to prevent gelation of the compositions herein, potassium chloride is highly effective and preferred. Potassium chloride is preferably added to the instant compositions to the extent of from about 1 to 3% by weight to provide its anti-gelling effects.

As noted, the employment of a solvent and electrolyte serves to control and regulate gel formation in liquid detergent compositions. If, however, gel formation is desired, it is possible to select particular concentrations of a water solvent which yield gelled compositions in the absence of alcohol and electrolyte salt.

Alkanolamine

Alkanolamine selected from the group consisting of monoethanolamine, diethanolamine, triethanolamine, and mixtures thereof may be useful in preparing liquid detergent compositions. Mixtures of these three alkanolamine compounds are produced by the reaction of ethylene oxide with ammonia. The pure compounds can be separated from this mixture by standard distillation procedures.

The alkanolamine component serves two purposes. It neutralizes the free acid form of the anionic surfactant to provide the corresponding alkanolamine salt. In addition, the excess alkanolamine beyond that necessary to form the anionic surfactant salt contributes to detergency performance and serves as a buffering agent which maintains wash water pH of detergent compositions within the range from about 7 to about 9. An excess of alkanolamine over that needed to neutralize the alkylbenzene sulfonic acid is desirable.

Stable liquid detergent compositions containing nonionic, anionic and alkanolamine components can be formulated by preparing each component separately and thoroughly mixing them together in any order. In a preferred method for preparing this type of composition, the anionic and alkanolamine components are formulated simultaneously by over-neutralizing the alkylbenzene sulfonic acid with alkanolamine. This method forms the requisite alkanolamine alkyl benzene sulfonate and further provides an excess of alkanolamine. Preferably, such compositions contain from about 2.0 to about 15.0 % by weight of free alkanolamine, most preferably triethanolamine.

Preferred liquid detergent compositions suitable for use in this invention comprise (a) from about 20 to about 50% by weight of a nonionic surfactant produced by the condensation of from about 2 to about 15 moles of ethylene oxide with one mole of a primary alcohol having a straight or branched alkyl chain having 8 to 12 carbon atoms, said nonionic surfactant being further characterized by an HLB (hydrophilic-lipophilic balance) of from about 8 to about 17.0, preferably 9.0 to 13.5, with the best range being 9.5 to 12, and a critical micelle concentration (CMC) from about 0.006 to about 0.10, preferably 0.008 to 0.05, weight percent, at 25° C.; (b) an anionic surfactant which is an alkanolamine salt thereof, wherein the weight ratio of nonionic surfactant to anionic surfactant is from about 1.4:1 to about 8.0:1, preferably 2.5:1 to 5.0:1, based on the free acid form of the anionic surfactant; (c) from 0.025 to 1.25%, preferably from 0.04 to 0.08%, sulfonated zinc phthalocyanine; (d) an alkanolamine sufficient to provide at least 1% by weight of the composition of free alkanolamine; (e) from about 0 to about 5% of an electrolyte salt which is not an alkaline detergency builder; and (f) the balance of the composition being a solvent chosen from the group comprised of water and water-alcohol mixtures wherein the alcohol contains from 1 to 5 carbon atoms and the weight ratio of water to alcohol is above 3:1.

Other optional components include brighteners, bluing agents, fluorescers, enzymes, anti-microbial agents, urea, corrosion inhibitors, suds suppressing agents, and coloring agents. Such components preferably comprise no more than about 3% by weight of the total composition.

Process

The process of this invention for removing stains from stained textile comprises treating stained textiles in the presence of oxygen with an aqueous liquor which is a dilution in water of the unbuilt liquid detergent compositions of this invention. The treatment bath should contain enough of the composition of the invention so that the concentration in the treatment bath of the bleach photoactivator is from 1–50 mgms. per liter of the treatment bath and the concentration of the water-soluble organic detergent in the treatment bath is from 0.2 to 2.0 gms. per liter of the treatment bath.

The stain removing process of the present invention is suitably carried out in the temperature range from 50° to 180° F. in the presence of visible light and oxygen. The time required to carry out the process varies. Exposure to bright sunlight for from about 15 minutes to about 3 hours, and preferably for 15 minutes to 1 hour, is effective. In an illuminated washer, a period of from 15 minutes to 5 hours is used and preferably a period of 15 minutes to 60 minutes.

In an illuminated washer, a suitable intensity of light is obtained from a 500 watt photo-flood lamp, with a flux of 16,000 lumens, mounted at a height of 3 to 6 inches above the surface of the bath.

Effective removal of stains can be obtained if the process is carried out at ordinary temperatures outdoors, the textiles in the treatment bath being exposed to daylight, preferably direct sunlight. This means that the process is admirably suited for household laundry purposes in those countries where domestic laundry operations are carried out outside, usually in strong sunlight, using water at the ambient temperature. Under such outdoor conditions, agitation of the bath is not convenient and longer exposure times may be required than are necessary when the process is carried out in an agitated bath under artificial light.

Another suitable method for utilizing the compositions of this invention to remove stains is to wash the textiles in solutions of these compositions and then expose the unrinsed textiles to light. The latter step is readily carried out by spreading the unrinsed textiles on the groud or other support, and periodically wetting the textiles during exposure to sunlight for a period of 1 to 4 hours. Such sunbleaching and rewetting processes are common practices among peoples who do not have access to washing machines and gas or electric dryers, especially in tropical countries where the sun is bright.

A further method of utilizing the compositions of the present invention involves washing the textiles in solutions of these compositions, optionally rinsing, and hanging them on the clothesline to dry in the sunlight.

While not wishing to be bound by theory, it is believed that the stain removal process follows the following course; first the photoactivator absorbs light to raise it to the triplet state $$^{1}\text{act.} + h\nu \rightarrow {}^{3}\text{act.}$$

This reacts with triplet oxygen to form singlet oxygen $$^{3}O_2 + {}^{3}\text{act.} \rightarrow {}^{1}O_2 + {}^{1}\text{act.}$$

The singlet oxygen oxidizes the stain to colorless or water-soluble oxidation products $$^{1}O_2 + \text{stain} \rightarrow \text{stain } O_2$$

Such a theory is suggested for the photoactivated oxidation of organic compounds by Foote and Wexler, J.A.C.S. 86, 3880 (1964).

The efficacy of the unbuilt liquid detergent composition of this invention in removing stain from textiles is demonstrated in the following examples. These examples are illustrative of the present invention, and they are not intended to limit the full scope of the invention as described herein.

EXAMPLE I

In the laboratory, textile bleaching performance was evaluated under simulated sun bleaching conditions. Swatches measuring 2½ by 2½ inches were placed in dishes for 4 hours under 100 watt tungsten lamps set 6 inches above the dish surface. The swatches were kept constantly moist by applying 2 ml. of the corresponding product solution containing 0.4% product and 2mM of $Ca^{++}$ every 20 minutes. After 4 hours the swatches were agitated in a Tergotometer for 5 minutes in a 0.4% Tide solution, rinsed, air dried and read on a Gardner XL-10 CDM. The reflectometer readings were converted to Diehl's (NF) whiteness and percent stain removal (SR) values. For percent SR values, a linear relationship between Diehl's whiteness values and percent SR was assumed. Diehl's whiteness values were calculated from the formula:

$$DW_{NF} = 100 - \sqrt{(100 - L)^2 + 5.29\,(a^2 + b^2)}$$

where $L$, $a$ and $b$ are values obtained from the Gardner XL-10 CDM.

One stain used was achuete, which was chosen because it is difficult to remove and shows up differences between samples well. Achuete is yellowish-red dyestuff prepared from the seeds of the annatto tree, *Bixa orellana,* which is native to tropical America. Eight ounces of seeds were boiled in 1½ gallons of city water for 2 hours. The solution was strained three times through a double layer of cheesecloth. Enough water was added to the strained solution to bring its volume back to 1½ gallons, and it was brought to a boil. Twenty-seven square feet of brightener-free cotton muslin were boiled in the solution for 2 hours, following which they were rinsed, passed through a padder wringer, dried in a tumble drier, and aged overnight in the dark at 120° F. Swatches measuring 2½ by 2½ inches in size were cut from the muslin and their lightness (L) was determined by the Gardner reflectometer. Swatches stained with tea and with curry were prepared by similar methods.

Stains investigated included achuete, curry and tea. Duplicate swatches were used with each stain, and duplicate runs were made for each test. The textile bleaching capability of an unbuilt liquid detergent composition without sulfonated zinc phthalocyanine was compared with the textile bleaching capability of the same liquid detergent composition, but containing various levels of sulfonated zinc phthalocyanine. The product composition is given in TABLE II, and the results of the experiment are given in TABLE III. These data show that the addition of sulfonated zinc phthalocyanine to a liquid detergent composition increases the ability of the system to remove stain from textiles. This is true for all three of the stains tested.

EXAMPLE II

The ability of the sulfonated zinc phthalocyanine to improve stain removal of an unbuilt liquid detergent composition was also demonstrated using a simulated sun soaking procedure. With this procedure, swatches measuring 2 by 2 inches are washed in a launderometer modified to include a hood lightbank of three 300 watt incandescent bulbs and a low speed transmission to reduce the rotor speed to 4 r.p.m. Each jar contains 4 swatches for a total load of 2 g. of cloth. Four hundred cc of wash solution is used in 10 gr./gal. of water. The wash cycle starts at 75° and reaches 110° F. at the end of the 3-hour exposure time. The swatches are rinsed for 1 minute in a beaker containing 10 gr. water at 75° F. The swatches are ironed dry at a moderate heat setting.

Swatches individually stained with black tea, curry and achuete were used as well as white muslin tracers. All swatch types were kept in separate jars. Readings were taken of swatches before and after washing, as described in EXAMPLE I, and the results expressed as percent of soil removal.

TABLE II

| | Product Formulations | |
|---|---|---|
| | Unbuilt Liquid Detergent Composition | Built Detergent Composition |
| Ethoxylated Coconut Alcohol | 33.0% | 33.0% |
| Triethanolamine | 11.0 | 11.0 |
| Alkylbenzene Sulfonic Acid | 11.0 | 11.0 |
| Sodium Tripolyphosphate | — | 32.5 |
| Ethanol | 5.0 | 5.0 |
| Water | 40.0 | 7.5 |

TABLE III

RESULTS FROM SIMULATED SUN BLEACHING (EXAMPLE I)

| Product | % Sulfonated Zinc Phthalocyanine** in Product | % Stain Removal | | |
|---|---|---|---|---|
| | | Achuete | Curry | Tea |
| Unbuilt Liquid Detergent* | 0.00 | 5.4 | 25.9 | 22.4 |
| | 0.04 | 12.8 | 27.8 | 45.0 |
| | 0.08 | 20.3 | 31.5 | 50.4 |
| | 0.16 | 27.9 | 36.8 | 59.5 |
| | 0.20 | 30.2 | 34.2 | 68.5 |
| | 0.24 | 31.6 | 38.4 | 63.7 |
| | 0.40 | 37.2 | 40.8 | 72.4 |
| | 0.80 | 42.3 | 41.2 | 68.5 |

*Composition Given in TABLE II
**Composition of Zinc Phthalocyanine

| | RDV |
|---|---|
| Unsulfonated | 0 |
| Monosulfonated | 0 |
| Disulfonated | 0 |
| Trisulfonated | 31 |
| Tetrasulfonated | 69 |

The results of this experiment are given in TABLE IV. These data demonstrate that benefits are observed when sulfonated zinc phthalocyanine is added to the liquid detergent composition.

EXAMPLE III

Using the simulated sun bleaching technique described in EXAMPLE I, an unbuilt liquid detergent composition was compared with a built liquid detergent composition containing 0, 0.2, 0.4 and 0.8% of the mixture of tetrasulfonated and trisulfonated zinc phthalocyanine of EXAMPLE I for removal of black tea and achuete stains from muslin swatches. Bleaching times of 30, 60 and 240 minutes were used. The results are given in TABLE V. The data demonstrate the ability of the sulfonated zinc phthalocyanine to improve the stain removal properties of an unbuilt liquid detergent composition as well as a similar built composition.

TABLE IV

% STAIN REMOVAL IN SIMULATED SUN SOAKING TEST (EXAMPLE II)

| Product | % Sulfonated Zinc Phthalocyanine** in Product | % Stain Removal | | |
|---|---|---|---|---|
| | | Achuete | Curry | Tea |
| Unbuilt Liquid Detergent | 0.0 | 12.8 | 19.0 | 21.0 |
| | 0.05 | 15.5 | 18.0 | 28.2 |
| | 0.1 | 18.5 | 21.0 | 29.0 |
| | 0.2 | 22.8 | 21.0 | 32.6 |

*Composition given in TABLE II
**Composition of Zinc Phthalocyanine

| | RDV |
|---|---|
| Unsulfonated | 0 |
| Monosulfonated | 0 |
| Disulfonated | 0 |
| Trisulfonated | 31 |
| Tetrasulfonated | 69 |

TABLE V

RESULTS FROM SIMULATED SUN BLEACHING TEST (EXAMPLE III)

| Product | % Sulfonated Zinc Phthalocyanine** in Product | % Stain Removal | | | | | |
|---|---|---|---|---|---|---|---|
| | | Achuete | | | Black Tea | | |
| | | 30 mins. | 60 mins. | 240 mins. | 30 mins. | 60 mins. | 240 mins. |
| Unbuilt Liquid Detergent* | 0.0 | 7.9 | 8.9 | 10.9 | 8.5 | 6.7 | −3.1 |
| | 0.2 | 13.0 | 18.1 | 42.6 | 14.0 | 24.7 | 66.9 |
| | 0.4 | 18.4 | 23.3 | 51.3 | 19.4 | 36.1 | 66.8 |
| | 0.8 | 22.7 | 34.2 | 64.9 | 25.7 | 41.9 | 66.7 |
| Built Liquid Detergent* | 0.0 | 3.8 | 5.6 | 7.6 | 19.6 | 20.6 | 27.7 |
| | 0.2 | 13.4 | 17.6 | 42.9 | 38.3 | 58.0 | 83.6 |
| | 0.4 | 15.3 | 21.6 | 52.4 | 41.2 | 56.8 | 79.7 |
| | 0.8 | 24.4 | 32.3 | 64.9 | 49.8 | 62.0 | 76.0 |

*Composition Given in TABLE II
**Composition of Zinc Phthalocyanine

| | RDV |
|---|---|
| Unsulfonated | 0 |
| Monosulfonated | 0 |
| Disulfonated | 0 |
| Trisulfonated | 31 |
| Tetrasulfonated | 69 |

EXAMPLE IV

The ability of the sulfonated zinc phthalocyanine to improve stain removal of an unbuilt liquid detergent composition consisting of a mixture of a nonionic and an anionic surfactant is demonstrated using the simulated sun soaking procedure described in EXAMPLE II.

Swatches individually stained with black tea, curry and achuete are used as well as white muslin tracers. All swatch types are kept in separate jars. Readings are taken of swatches before and after washing, as described in EXAMPLE I, and the results are expressed as percent of soil removal. These results are presented in TABLE VI.

TABLE VI

% STAIN REMOVAL IN SIMULATED SUN SOAKING TEST (EXAMPLE IV)

| % Sulfonated Zinc Phthalocyanine in Product* | % Stain Removal | | |
|---|---|---|---|
| | Achuete | Curry | Tea |
| 0.00 | 13.3 | 20.0 | 22.0 |
| 0.05 | 16.5 | 19.0 | 29.7 |
| 0.10 | 19.4 | 22.1 | 30.5 |
| 0.20 | 23.9 | 22.0 | 34.1 |

*Product
33% Primary Alcohol (5% $C_8$, 95% $C_{10}$) Condensed with 4.5 moles of ethylene oxide
11% Linear Alkylbenzene Sulfonic Acid
11% Triethanolamine
5% Ethanol
2% KCl

EXAMPLE V

Other examples of compositions of the instant invention are given in TABLE VII. They provide a good bleaching and stain removal properties.

TABLE VII

EXAMPLES OF LIQUID DETERGENT COMPOSITIONS OF THE INSTANT INVENTION

| Components | Wt. % of the Total Composition | | | | | | | | | | | | | |
|---|---|---|---|---|---|---|---|---|---|---|---|---|---|---|
| | Ex. | a | b | c | d | e | f | g | h | i | j | k | l | m |
| $C_{10}H_{21}(OCH_2CH_2)_9OH$ | 20 | 50 | 35 | | | 20 | | | | | | 18 | 30 | |
| $C_9H_{19}$ 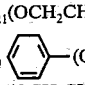 $-(OCH_2CH_2)_6OH$ | | | | | | | | | | | 12 | 30 | | |
| $C_{12}H_{25}(OCH_2CH_2)_3OSO_3NH_4$ | | | | | 20 | 40 | | | 20 | 40 | | | | |
| $C_{12}H_{25}$ 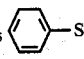 $-SO_3H \cdot N(CH_2CH_2OH)_3$ | 16 | 9.2 | 10 | | | 15 | 25* | | | | | 40 | 30 | |
| $C_{12}H_{25}N(CH_3)_2 \rightarrow O$ | | | | | 6.6 | 5.7 | | | 20 | 5.7 | | | | |
| $C_{11}H_{23}CONH(CH_2CH_2OH)_2$ | | | | | | | 40 | 3 | | | | | 20 | 15 |
| Sodium Dodecyl Glyceryl Sulfonate | | | | | | | | | 10 | 2 | | | | |
| $C_8H_{17}CH{=}CH(CH_2)_7CO_2H$ | | | | | | | | | | | 8 | 5 | | |

TABLE VII-continued

EXAMPLES OF LIQUID DETERGENT COMPOSITIONS OF THE INSTANT INVENTION

| | | | | | | | | | | | | | | |
|---|---|---|---|---|---|---|---|---|---|---|---|---|---|---|
| Triethanolamine | | 1 | 1 | 1 | | | | | | | 15 | 50 | 20 | 14 |
| Ethanol | | | | | 20 | 5 | | 5 | 40 | 5 | | | | 1 |
| Glycol Monobutyl Ether | | | | | | | 10 | | | | | | | |
| KCl | | | 3 | | | | | | | | | | 1 | |
| Urea | | | | | | | | 12 | | | | | | |
| $H_2O$ | | | | | | ← | BALANCE | | | → | | | | |
| Sulfonated Zinc Phthalocyanine | A | | 1.07 | | | | | | | | 1.00 | | | |
| | B | 1.25 | | | | 1.16 | | | | | | | | |
| | C | | | .93 | | | | | | .85 | | | | |
| | D | | | | .77 | | | | | | | .70 | | |
| | E | | | | | | | | .35 | | | | .20 | .025 |
| | F | | | | | | .50 | .61 | | | | | | |

| | A RDV | B RDV | C RDV | D RDV | E RDV | F RDV |
|---|---|---|---|---|---|---|
| Unsulfonated Zinc Phthalocyanine | 0 | 0 | 0 | 0 | 0 | 0 |
| Monosulfonated Zinc Phthalocyanine | 0 | 0 | 0 | 0 | 0 | 0 |
| Disulfonated Zinc Phthalocyanine | 4 | 0 | 15 | 4 | 0 | 0 |
| Trisulfonated Zinc Phthalocyanine | 64 | 94 | 30 | 21 | 6 | 16 |
| Tetrasulfonated Zinc Phthalocyanine | 32 | 6 | 55 | 74 | 94 | 84 |

*Sodium Salt

What is claimed is:

1. An unbuilt liquid detergent composition consisting essentially of:

(a) from 10 to 80% by weight of the composition of a water-soluble organic surfactant chosen from the group consisting of water-soluble anionic and nonionic surfactants and mixtures thereof;

(b) 0.04 to 0.80% by weight of the composition of sulfonated zinc phthalocyanine species characterized by RDV's for its individual species as follows:
Unsulfonated: 0
Monosulfonated: 0
Disulfonated: 0
Tetrasulfonated:84–94
Trisulfonated: (100)-(RDV for tetrasulfonated);

(c) 0 to 5% by weight of the composition of an electrolyte salt which is not an alkaline detergency builder salt;

(d) 1 to 90% by weight of the composition of a solvent which is chosen from the group consisting of water and alcohol in which the alcohol is a lower hydrocarbon monohydric alcohol containing from 1 to 5 carbon atoms; and (e) 0 to 50% by weight of the composition of free alkanolamine selected from the group consisting of mono-, di-, and triethanolamine and mixtures thereof.

2. A composition according to claim 1 wherein the water-soluble organic surfactant is present in an amount of from 20 to 50% by weight of the composition and in which the electrolyte salt is present in an amount of from 0.2 to 5% by weight of the composition and in which the solvent is present in an amount of from 20 to 80% by weight of the composition.

3. A composition according to claim 2 wherein the solvent is a mixture of water and alcohol in which the weight ratio of water to alcohol is greater than 3:1.

4. A composition according to claim 3 wherein the solvent is a mixture of water and alcohol in which the weight ratio of water to alcohol is from 4:1 to about 7:1.

5. A composition according to claim 2 wherein the water-soluble organic surfactant is a mixture of a nonionic surfactant chosen from the group consisting of a polyoxyethylene oxide alkylphenol condensate having 5–25 ethylene oxide groups per mole of alkyl phenol and having 6 to 12 carbon atoms in the alkyl group of the alkyl phenol, a condensation product of an aliphatic alcohol with ethylene oxide having 2 to 15 moles of ethylene oxide per mole of alcohol and and having 8 to 22 carbon atoms in the alkyl group of the aliphatic alcohol, and a trialkyl amine oxide having a straight chain alkyl group having from 10 to 14 carbon atoms therein and two short chain alkyl groups having 1 to 2 carbon atoms therein; and an anionic surfactant chosen from the group consisting of alkali metal ammonium, amine and ethanolamine salts of $C_{10-14}$ linear alkyl aryl sulfonic acids, $C_{10-16}$ $\alpha$-olefin sulfonic acids, $C_{10-18}$ polyglycolether sulfuric acids and $\alpha$-sulfonated $C_{12-18}$ fatty acids and wherein the weight ratio of nonionic surfactant to anionic surfactant in the composition is from about 1:8 to 8:1 based on the free acid form of the anionic surfactant.

6. A composition according to claim 5 wherein the water-soluble organic surfactant is a mixture of a nonionic surfactant produced by the condensation of from about 2 to about 15 moles of ethylene oxide with one mole of an alcohol having a straight or branched chain having 8 to 12 carbon atoms therein, and an anionic surfactant which is an ethanolamine salt of an alkylbenzene sulfonic acid in which the alkyl group of the alkylbenzene sulfonic acid has 10 to 14 carbon atoms therein, and wherein the weight ratio of nonionic surfactant to anionic surfactant in the composition is from 1.4:1 to 8:1.

7. A composition according to claim 6 wherein the electrolyte salt is chosen from the group consisting of the alkali metal chlorides and sulfates and the salts formed from the reaction of alkanolamines with sulfuric acid and hydrochloric acid and formic acid, acetic acid, propionic acid and butyric acid.

8. A composition according to claim 7 wherein the electrolyte is from 1 to 3% of potassium chloride.

9. A composition according to claim 8 wherein the free alkanolamine is at least 1% by weight of the composition and wherein the nonionic surfactant is further characterized by an HLB of from about 8.0 to about 17.0 and by a CMC from about 0.006 to about 0.10 weight percent at 25° C.

10. A composition according to claim 1 wherein the free alkanolamine is from about 2 to about 15% by weight of the composition.

11. A composition according to claim 10 wherein the water-soluble organic surfactant is present in an amount of from 20 to 50% by weight of the composition and in which the electrolyte salt is present in an amount of from 0.2 to 5% by weight of the composition and in which the solvent is present in an amount of from 20 to 80% by weight of the composition.

12. A composition according to claim 11 wherein the solvent is a mixture of water and alcohol in which the weight ratio of water to alcohol is greater than 3:1.

13. A composition according to claim 11 wherein the electrolyte salt is chosen from the group consisting of the alkali metal chlorides and sulfates and the salts formed from the reaction of alkanolamines with sulfuric acid and hydrochloric acid and formic acid, acetic acid, propionic acid and butyric acid.

14. A composition according to claim 13 wherein the electrolyte is from 1 to 3% of potassium chloride.

* * * * *